US005839564A

United States Patent [19]

Cox

[11] Patent Number: 5,839,564

[45] Date of Patent: Nov. 24, 1998

[54] ADJUSTABLE YOKE ASSEMBLY

[75] Inventor: Michael S. Cox, Fayetteville, W. Va.

[73] Assignee: Long-Airdox Company, Blacksburg, Va.

[21] Appl. No.: 903,264

[22] Filed: Jul. 25, 1997

Related U.S. Application Data

[60] Continuation of Ser. No. 725,028, Oct. 2, 1996, abandoned, which is a division of Ser. No. 350,305, Dec. 6, 1994, abandoned.

[51] Int. Cl.[6] ..... B65G 65/02

[52] U.S. Cl. ..... 198/303; 198/587

[58] Field of Search ..... 198/584, 587, 198/861.1, 861.6, 303, 317

[56] References Cited

U.S. PATENT DOCUMENTS

| | | | |
|---|---|---|---|
| 2,232,081 | 2/1941 | Sloane | 198/587 |
| 2,722,409 | 11/1955 | Bergmann | 198/587 X |
| 2,796,999 | 6/1957 | Russell | 198/587 X |
| 2,805,760 | 9/1957 | Von Stroh et al. | 198/584 |
| 3,017,012 | 1/1962 | Wilde | 198/584 |
| 3,561,622 | 2/1971 | Dioguardi et al. | 198/584 X |
| 3,863,752 | 2/1975 | Sibley | 198/303 |
| 4,361,219 | 11/1982 | Aldridge et al. | 198/587 X |
| 4,776,445 | 10/1988 | Zitz et al. | 198/587 X |
| 5,244,072 | 9/1993 | Etherington et al. | 198/303 |

*Primary Examiner*—Karen M. Young
*Assistant Examiner*—Thuy V. Tran
*Attorney, Agent, or Firm*—Rudnick & Wolfe

[57] ABSTRACT

The present invention is directed to an adjustable yoke assembly adapted to pivotally connect components of a continuous haulage system designed for use in underground excavation environments. The yoke assembly is vertically adjustable relative to the component it is carried on by selectively securing the assembly to the component through a series vertically aligned openings.

16 Claims, 7 Drawing Sheets

ADJUSTABLE YOKE ASSEMBLY

This application is a continuation of application Ser. No. 08/725,028 filed on Oct. 2, 1996, now abandoned, which is a division of application Ser. No. 08/350,305 filed Dec. 6, 1994, now abandoned.

FIELD OF THE INVENTION

The present invention is directed to an adjustable yoke assembly, and more particularly to vertically adjustable yoke assemblies used to connect components of a continuous haulage system designed for use in underground excavation environments.

BACKGROUND OF THE INVENTION

When performing underground excavation, such as for example coal mining operations, it is desirable for efficiency purposes to continuously operate the mining apparatus breaking coal away from the face. In order to do so, means must be available for quickly and continuously hauling the loosened material from the mining site to an area removed from the mining site.

One such continuous haulage system presently available and used in coal mines comprises a series of conveyor mechanisms pivotally linked together. The components of this system wind there way through the mine from a continuous miner which breaks up the solid coal deposits to material sized to be more easily transported to an area distal therefrom. Some of the components which comprise these systems may be self-propelled mobile conveyor units while others may be conveyors which span or bridge an area between mobile units. The mobile units used in the continuous haulage system are sometimes referred to as mobile bridge carriers and are generally crawler mounted chain conveyor units.

In a continuous haulage system which may include, for example, several mobile bridge carriers, the first of the several mobile bridge carriers is positioned adjacent to the discharge end of a continuous miner. The mobile bridge carrier moves in concert with the continuous miner and accepts the mined material in a small hopper at its receiving end. Alternatively, a Feeder-Breaker may be positioned between the continuous miner and the mobile bridge carrier to break up the larger pieces of mined material. The discharge end of the mobile bridge carrier is pivotally connected to another continuous haulage system component, generally a bridge conveyor. A series of pivotally connected mobile bridge carriers and bridge conveyors provide the means to articulate the continuous haulage system around corners and allows it to move in concert with the continuous miner. The continuous haulage system thus provides a quick and efficient means for transporting the mined material from the face.

The pivotal connections between the various components of the continuous haulage system are generally provided by a yoke assembly including cooperating male and female portions. The yoke assembly, in the past, has been welded in a predetermined fixed position on the ends of the various components of the continuous haulage system. While welding yoke assemblies to the components does provide considerable structural strength which is necessary in the rugged environment of an underground excavation site, welding yoke assemblies also poses some considerable drawbacks.

The environment in which these continuous haulage systems are used may include seams in an underground excavation that may be as low as 32 inches high. One problem with welding the yoke assemblies in a fixed position, particularly when the continuous haulage system is maneuvered in a mine environment where the floor has undulations or rough spots, is that adjacent ends of the series of pivotally connected components have a tendency to interfere with each other. Additionally, seam heights in underground excavations are not consistent. Thus, in order to allow the system to be moved through a seam in concert with the continuous miner, the height of the yoke assembly connecting the various components is generally selected and welded at its lowest height so that it is movable through a seam of a low height. However, setting the yoke at a low level does not address the problem of interference between components. Furthermore, setting the yoke assembly at its lowest height limits the flow of material through the conveyor. Thus, if the continuous haulage system were being used in a seam which would permit the yoke assembly to be raised, running the system with the yoke assembly at its lowest height severely reduces the efficiency of the operation. Adjusting a welded yoke assembly is no easy task, and in order to raise a welded yoke assembly to a higher level when the seam height will allow such adjustment, the welded yokes would have to be severed and rewelded generally requiring several days work.

SUMMARY OF THE INVENTION

It is a general object of the present invention to provide an adjustable height yoke assembly for use in connecting underground excavation machinery which overcomes the deficiencies of previously used yoke assemblies. It is a further object of the present invention to provide a bridge conveyor including adjustable height yoke assemblies for connecting components of a continuous haulage system together.

In accordance with a preferred embodiment of the invention, and adjustable yoke assembly is provided including a male yoke assembly and female yoke assembly. The male yoke assembly includes a connecting pin carried on a generally horizontally extending male yoke plate. The male yoke plate is supported by a pair of spaced apart vertically extending retainer plates. Each of the retainer plates include a series of vertically aligned holes adapted to receive attachment pins for adjustably securing the male yoke assembly to a component of a continuous haulage system. The female yoke assembly includes a generally horizontally extending female yoke plate supported by an attachment frame. The attachment frame is adjustably secured to an adjacent component of a continuous haulage system by a series of vertically aligned bolts. The female yoke plate includes an opening therethrough for receiving the connecting pin of a corresponding male yoke plate in order to pivotally connect adjacent components of a continuous haulage system.

It is to be understood that both the foregoing general description and the following detailed description are exemplary and are intended to provide further explanation of the invention claimed. The accompanying drawings, which are incorporated and constitute part of this specification are included to illustrate and provide a further understanding of the apparatus and method of operation of the claimed invention.

BRIEF DESCRIPTION OF THE DRAWINGS

The present invention may be better understood with reference to the detailed description in conjunction with the following figures where like numerals denote identical elements, and in which.

DETAILED DESCRIPTION OF THE PREFERRED EMBODIMENT

Figure 1:
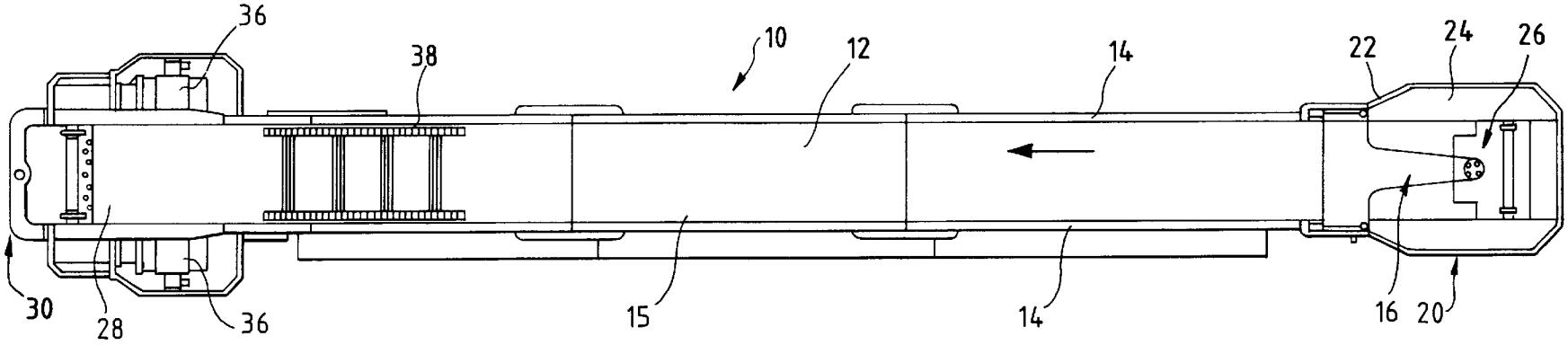
FIG. 1 is a top plan view of a bridge conveyor made according to the present invention.
Figure 2:
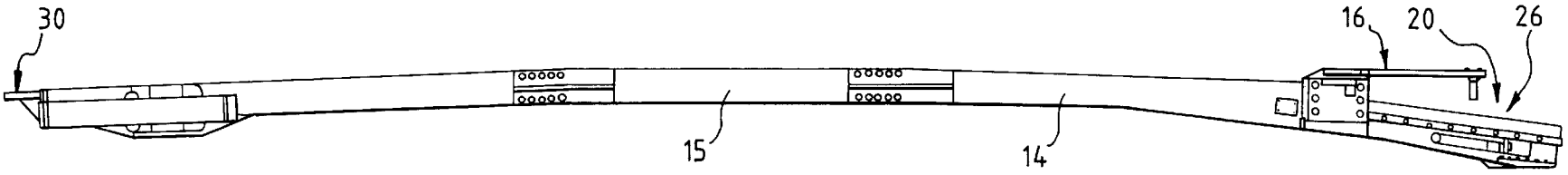
FIG. 2 is a side elevational view of the bridge conveyor of FIG. 1.

Referring to FIGS. 1 and 2, a bridge conveyor made in accordance with the present invention is illustrated and shown generally at 10.

The bridge conveyor includes a chain driven conveyor assembly 12 of a type well known in the art carried by a pair of spaced support rails 14. A male pin on yoke assembly 16 is connected at the receiving end 20 of the bridge conveyor 10 for connecting the bridge conveyor to other components of a continuous haulage system, such as, the discharge end of a continuous miner. The bridge conveyor 10 includes a receiving end 20 formed from a retaining bar 22 and skirt 24 which forms the receiving area 26. Mined material from an adjacent continuous haulage system component is dumped into the receiving area 26 and carried along the conveyor 12 in a left-hand direction as shown by the arrow in FIG. 1. The linear speed of the chain driven conveyor 12 is approximately 300 to 400 feet per minute. The speed of the conveyor 12 may be preselected and coordinated with the other components in the continuous haulage system depending on the conditions of the seam. Additionally, the bridge conveyor 10 may be provided with a bolt on intermediate section that may be added to increase the length of the bridge conveyor 10.

Figure 5:
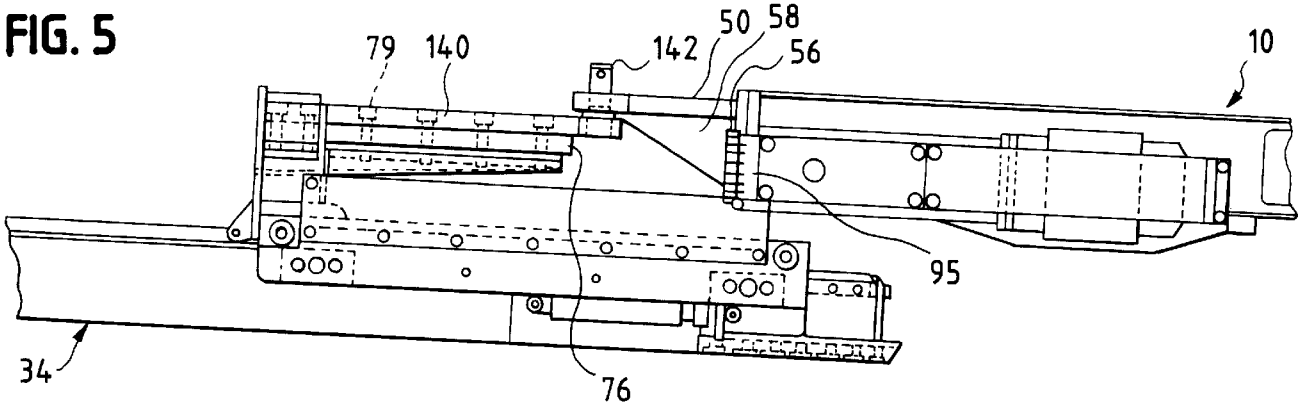
FIG. 5 is a side elevational view of an alternative embodiment of the present invention illustrating a pivotal connection between components of a continuous haulage system at a first height.
Figure 6:
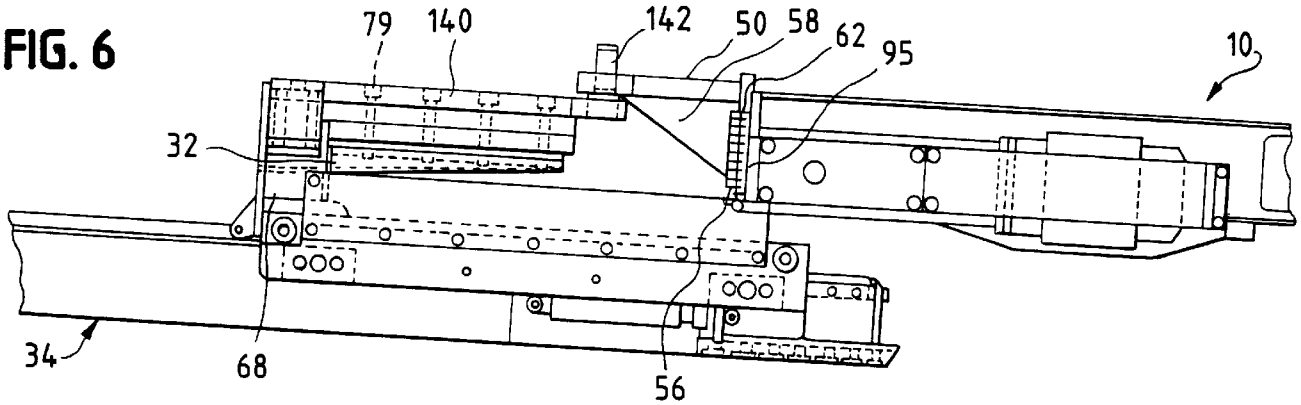
FIG. 6 is a side elevational view of the components of FIG. 5 illustrating the pivotal connection at a second height.
Figure 7:
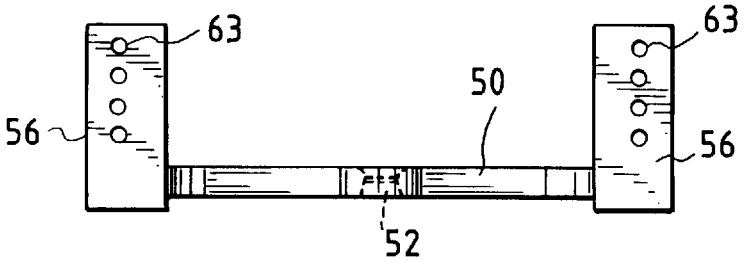
FIG. 7 is a front elevational view of a female yoke assembly made according to the present invention.
Figure 9:
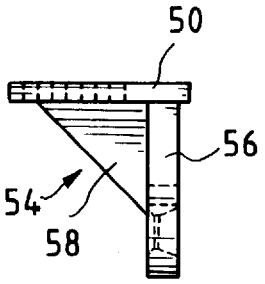
FIG. 9 is a side elevational view of the female yoke assembly of FIG. 7.
Figure 8:
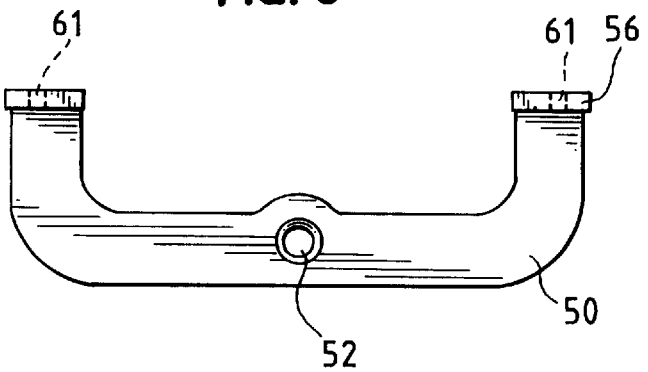
FIG. 8 is a top plan view of the female yoke assembly of FIG. 7.
Figure 10:
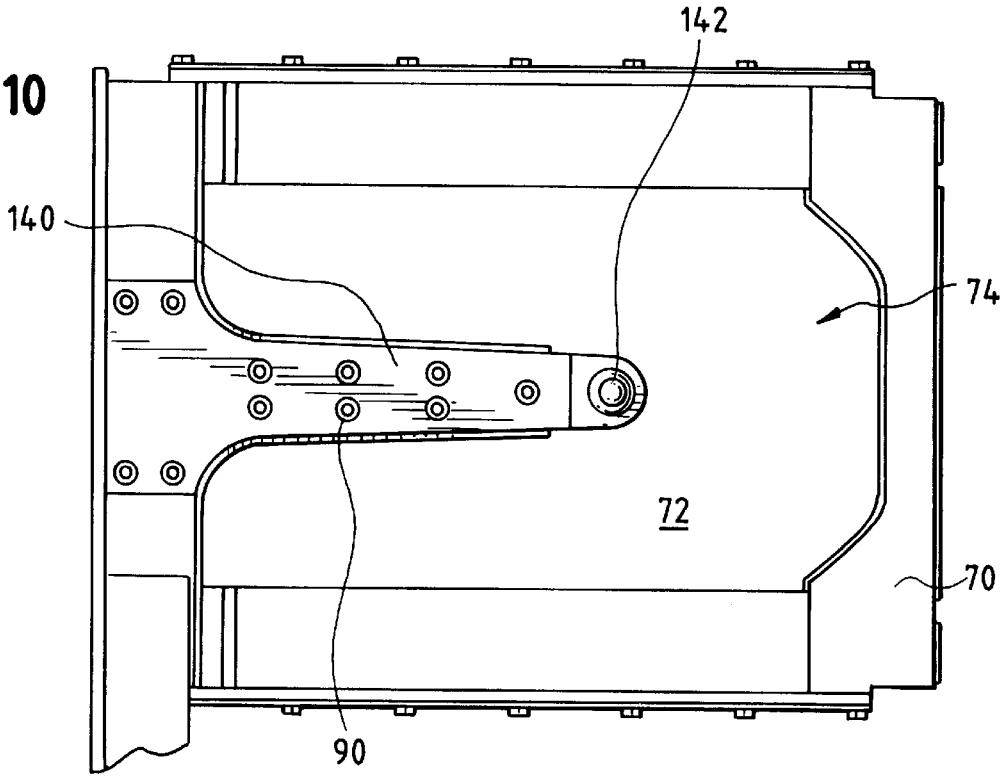
FIG. 10 is a top plan view of a male yoke assembly made according to the present invention.
Figure 11:
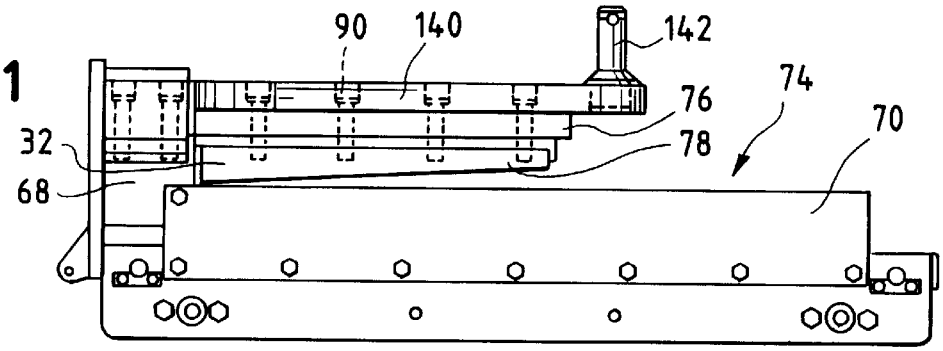
FIG. 11 is a side elevational view of the male yoke assembly of FIG. 10.
Figure 12:
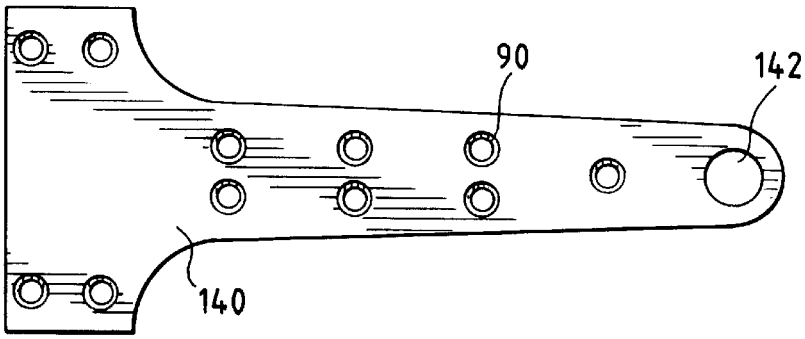
FIG. 12 is a top plan view of a male yoke plate made according to the present invention.
Figure 13:
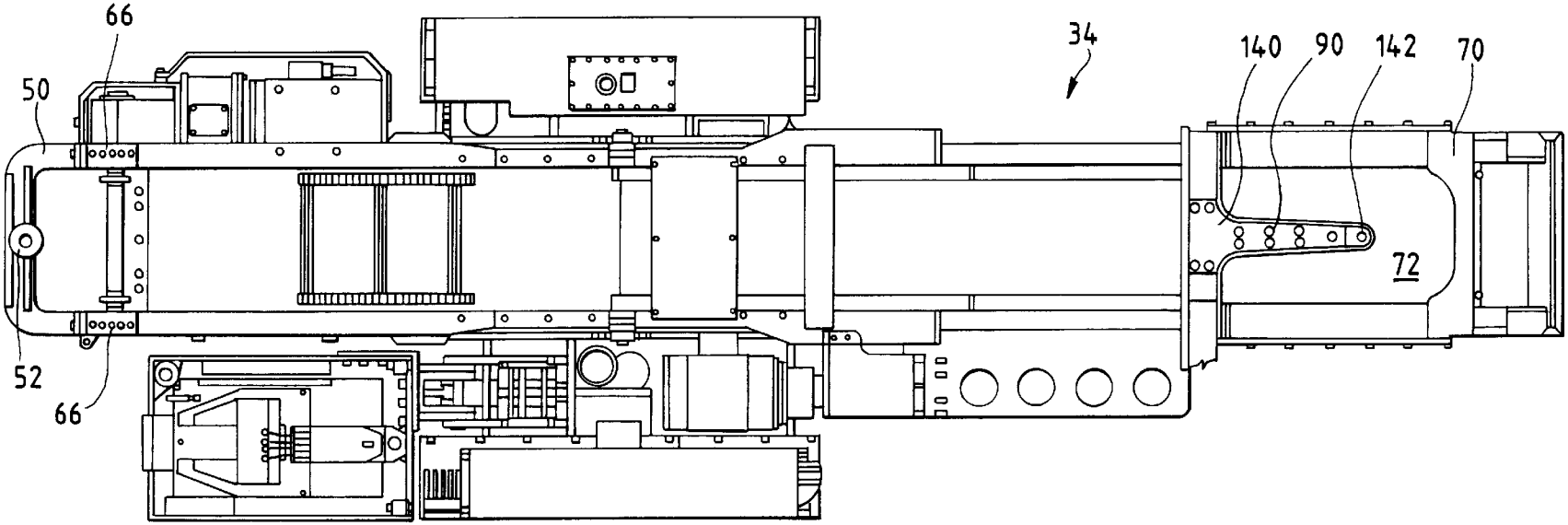
FIG. 13 is a top plan view of a mobile bridge carrier including an adjustable yoke assembly made according to the present invention.
Figure 14:
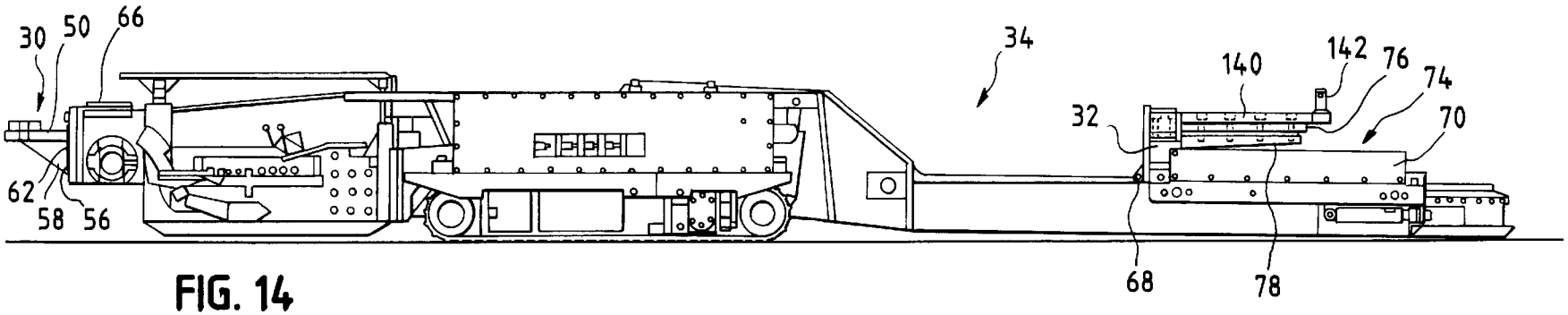
FIG. 14 is a side elevational view of the mobile bridge carrier of FIG. 13.

The conveyor 12 ends at the discharge end 28 of the bridge conveyor 10 and includes a female yoke assembly 30 adapted to cooperate with a male yoke assembly carried on an adjacent component for pivotally connecting the bridge conveyor 10 and the adjacent component together. For example, as illustrated in FIGS. 5 and 6 the discharge end 28 of the bridge conveyor 10 may be pivotally connected to a traveling dolly 32 on a mobile bridge carrier 34.

Motors 36 for powering the chain 38 are housed adjacent the discharge end 28 of the bridge conveyor 10. Power to the motors 36 are supplied by cables as is well known in the art.

Figure 3:
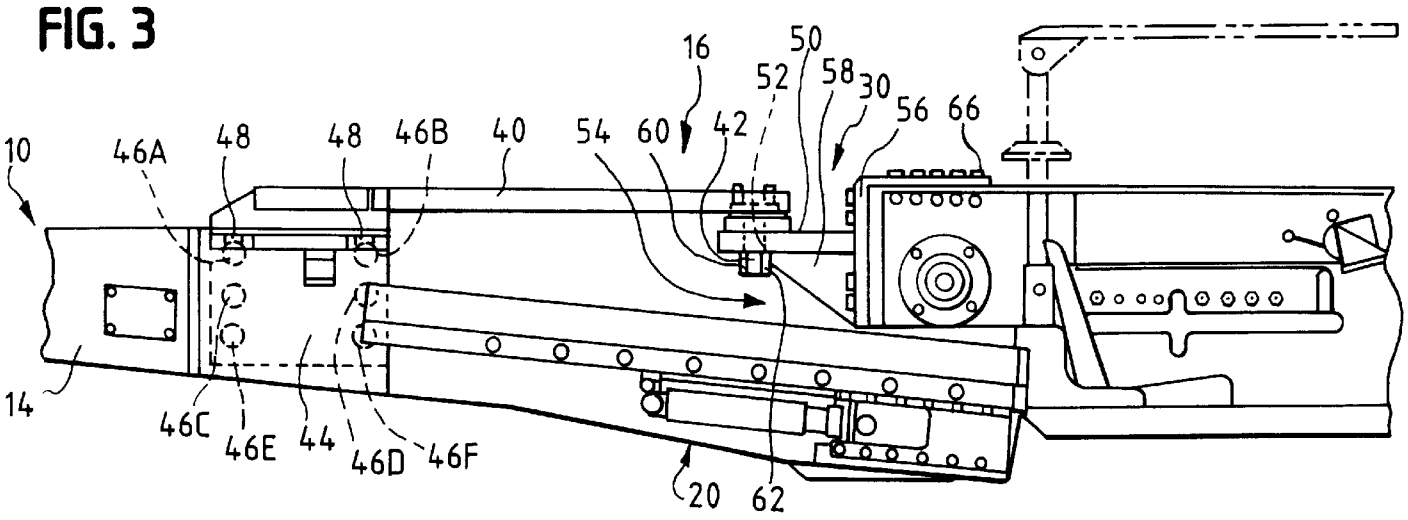
FIG. 3 is a side elevational view illustrating the pivotal connection between components of a continuous haulage system made according to the present invention at a first height.
Figure 4:
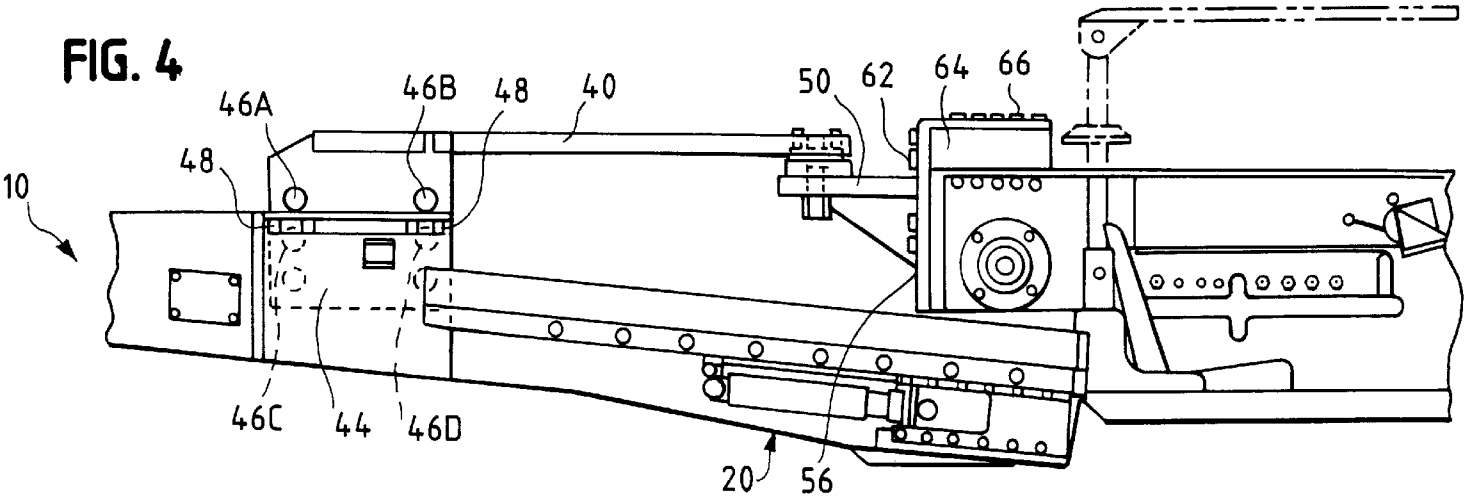
FIG. 4 is a side elevational view of the components of FIG. 3 illustrating the pivotal connection at a second height.

Referring to FIGS. 2 through 4, the male pin on yoke assembly 16 is removably and adjustably connected to the receiving end of the bridge conveyor 10 and includes a yoke plate 40 extending in a generally horizontal plane and carrying a connecting pin 42 extending downwardly from the underside of the yoke plate 40. The yoke plate 40 is preferably welded along its rearward edge to a pair of spaced yoke retainer plates 44 extending perpendicularly from the yoke plate 40. The yoke retainer plates 44 each include a series of vertically aligned openings 46 adapted to receive pins or bolts therethrough for connecting the yoke retainer plates 44 to the bridge conveyor 10. The bridge conveyor 10 includes a pair of generally horizontally spaced holes 48 through its support rails 14 for receiving the yoke retainer pins for securing the yoke assembly 16 to the bridge conveyor 10.

The male yoke assembly 16 may be raised or lowered depending on the orientation of the openings 46 on the retainer plates 44 with the holes 48 on the bridge conveyor 10. It is preferred that the height of the yoke plate be adjustable from approximately 29 inches to approximately 37 inches (from the ground?) to accommodate various seam heights and provide the advantages described herein.

A female yoke assembly 30 is attached to the discharge end 28 of the bridge conveyor 10 and includes a female yoke plate 50 having an opening 52 therethrough for receiving the connecting pin 42 extending from a male yoke plate 40. It should be understood that any pivotal coupling mechanism may be employed by the male and female yoke assemblies including for example, a ball and socket coupling. The female yoke plate 50 is supported by an attachment assembly 54 including a pair of face plates 56 and angle support braces 58. The female yoke plate 50 is preferably welded to the face plates 56 and the angle support braces 58. Alternatively, the female yoke assembly 30 may be integrally cast.

The female yoke assembly 30 is connected to the bridge conveyor 10 by bolts 62 extending through holes 63 in the face plates 56 into the support rails 14 of the bridge conveyor 10. The height of the female yoke assembly may also be adjusted by varying the height relative to the support rails 14 of the bridge conveyor 10 at which the face plates 56 are bolted to the bridge conveyor 10.

Referring to FIGS. 3 and 4, an adjustment to the height of the male and female yoke assemblies is illustrated. As illustrated in FIG. 3, the male yoke assembly 16 attached to the receiving end 20 of the bridge conveyor 10 cooperates with a female yoke assembly 30 attached to the discharge end of another component in the continuous haulage system to pivotally connect successive components in the system. The pivotal connection is accomplished by inserting the connecting pin 42 of the male yoke plate 40 into the opening 52 in the female yoke plate 50. The connecting pin may be secured in the opening 52 in any suitable manner, such as by the use of a cotter pin assembly 60 which prevents the connecting pin 42 from being removed from the opening 52.

As illustrated in FIG. 3, both the male yoke assembly 16 and the female yoke assembly 30 are positioned at their lowest level with respect to the components to which they are attached. Turning to FIG. 4, both the male and female yoke assemblies, 16, 30 are illustrated in a position raised from that shown in FIG. 3. With respect to the male yoke assembly in FIG. 3, retainer plate 44 is connected to the bridge conveyor 10 by pins extending through openings 46A and 46B and holes 48. In FIG. 4, retainer plate 44 is now connected to bridge conveyor 10 by pins extending through openings 46C and 46D and holes 48 thus raising the height of the yoke plate 40 with respect to the bridge conveyor 10. Additionally, the position of the female yoke assembly 30 has been raised from its initial position as illustrated in FIG. 3 to its new position illustrated in FIG. 4. The face plates 56 have been raised relative to the discharge end of the continuous haulage system component to which it is attached such as a mobile bridge carrier and reconnected by bolts 62. In order to compensate for the raised position of the face plates 56, a spacer 64 has been added to the end of the component and connected in place by bolts 66. Bolts 62 may then be inserted through the face plates 56 and into the spacer to connect the female yoke assembly to the discharge end of the component. Additional spacers or spacers of increased thickness may be utilized when necessary to raise the female yoke assembly 30 further upwardly.

It should be noted that when both the male and female yoke assemblies are raised equal distances, the vertical distance between the adjacent components pivotally connected by the yoke assemblies remains unchanged. This type of adjustment would be beneficial where interference between components is not a problem, but where increased flow through of material between components is desired. On the other hand, where interference between components of the continuous haulage system is occurring, due possibly to undulations in the mine floor, raising either the male yoke assembly 16 or the female yoke assembly 30 with respect to each other will increase the vertical distance between the pivotally connected components. Alternatively, varying the height of both the male and female yoke assemblies, but doing so unequally can provide both increased flow through of material and prevent interference between components. It is of course understood that a wide variety of combinations are available which are dependent only upon the extent conditions and the desire of the operator.

In an alternative embodiment of the present invention, the male yoke assembly may be connected to a dolly 32 on a mobile bridge carrier 34 as illustrated in FIGS. 10 through 14. The male yoke assembly includes a male yoke plate 140 and an upwardly extending connecting pin 142. The dolly 32 includes a support frame 68 which rides along guide rails disposed adjacent the receiving end of a mobile bridge carrier 34. The dolly 32 includes a receiving area 74 defined by a skirt 70 connected to the support frame 68 and open at its bottom to a conveyor 72 of the mobile bridge carrier 34. The dolly is designed to travel along the receiving end of the mobile bridge conveyor 34. Having a travel distance of approximately five feet, the dolly is designed to provide slack and to compensate for movement of the continuous haulage system. For example, when the continuous miner of a continuous haulage system is advanced, all of the mobile bridge carrier may not react to that movement immediately. Thus, movement of the dolly 32 provides slack in the system preventing undue stress from occurring at the pivotal connections between components.

The male yoke plate 140 is connected to a portion 78 of the support frame 68 which extends into the receiving area 74 of the dolly 32. The yoke plate 140 is secured to the support frame by a series of bolts 90. A spacer 76 is provided between the yoke plate 140 and the portion 78 to raise the height of the yoke plate 140.

Turning to FIGS. 5 and 6, the discharge end of a bridge conveyor 10 is illustrated connected to a mobile bridge carrier 34 by a female yoke assembly 30 and a male yoke assembly 140. The connecting pin 142 of male yoke plate 140 is inserted into opening 52 and secured thereto, preferably by a cotter pin assembly 60. In FIG. 5, a single spacer 76 is provided setting the height of the male yoke plate 140. In FIG. 6, two spacers 76 have been inserted between the yoke plate 142 and portion 78 to raise the height of yoke plate 140 from that depicted in FIG. 5. Likewise, female yoke assembly 30 has been raised an equal distance in a manner as described above.

Alternatively, as depicted in FIGS. 5 and 6, the face plates 56 may be formed with all of the openings 63 disposed lower than the yoke plate 50. The female yoke assembly may then be raised by removing bolts 62 and raising the face plates 56 and reinserting bolts 62 into a different set of vertically aligned holes 95 in the discharge end of the bridge conveyor 10. It should be understood that holes 95 are disposed in a series of vertically aligned columns. In the embodiment of the female yoke assembly illustrated in FIGS. 5 and 6, a spacer is not needed, however, vertical movement of the female yoke plate may be limited without the spacer.

Any number of spacers or spacers of increased thickness may be added to increase the height of the male yoke plate relative to the mobile bridge carrier 34. As noted before, various combinations of raising or maintaining the height of the cooperating yoke assemblies is possible depending on the mine conditions and the desired results.

Figure 15:
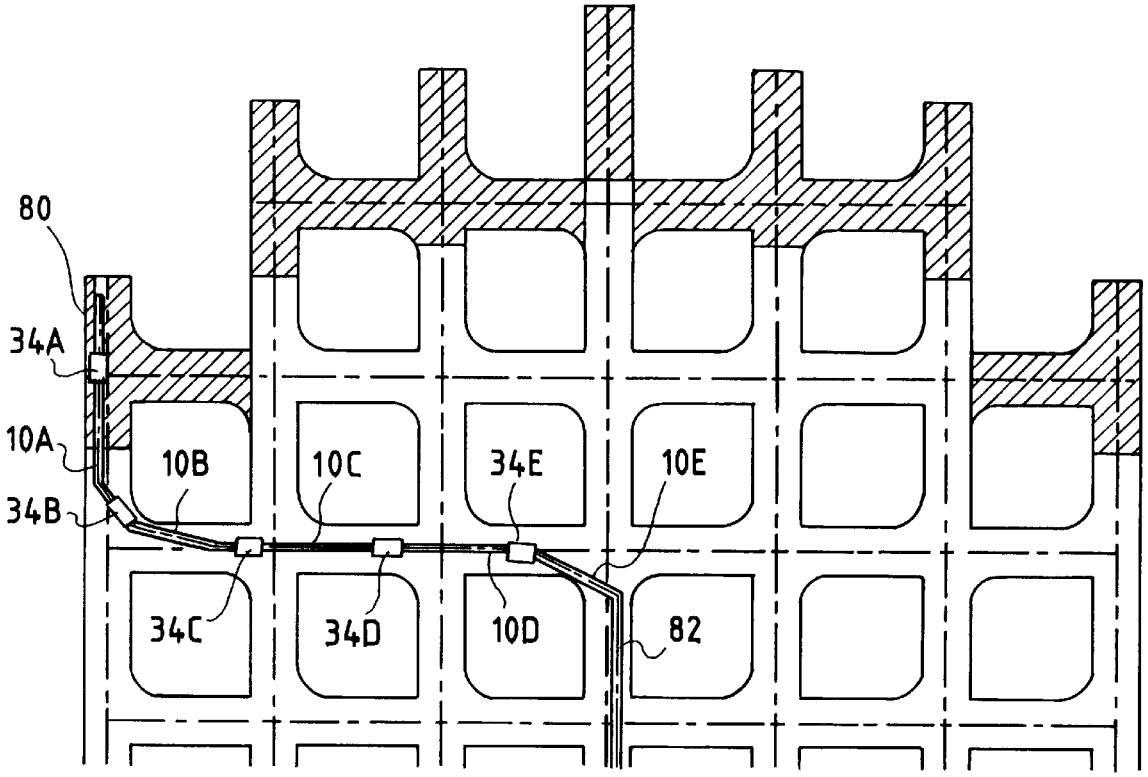
FIG. 15 is a plan view of an underground excavation site illustrating the position of a continuous haulage system.

FIG. 15 illustrates the environment in which a continuous haulage system is used. As illustrated, a continuous miner 80 is removing coal from a face, and its discharge end is positioned adjacent to a mobile bridge carrier 34A. In addition, a series of mobile bridge carriers 34B, C, D, E are interconnected by a series of bridge conveyors 10A, B, C, D to mobile bridge carrier 34A. A final bridge conveyor 10E is connected from the discharge end of a mobile bridge carrier 34E to a rigid frame modular tail piece 82 which conveys the coal out of the mine. In this continuous haulage system, each of the connections between the bridge conveyors 10 and the mobile bridge carriers 34 are formed with adjustable height yoke assemblies made according to the present invention which may be adjusted to the appropriate height for the conditions of that particular seam.

In addition to adjusting the yoke assembly heights to accommodate various seam heights, the yoke assembly heights may be adjusted in order to compensate for continuous haulage system wherein the conveyor speeds are increased, for example, from 300 feet per minute to 400 feet per minute. Increasing the conveyor speeds require the yoke assemblies to be adjusted to increase the vertical distance between the adjacent components to compensate for the greater trajectory of the material being conveyed. Moreover, when seam heights allow, the yoke assembly should be adjusted to its higher position to allow a greater flow of material and larger lumps of materials to be passed between the connected components that comprise the continuous haulage system without interference from the yoke assemblies. This allows the continuous miner to operate at a higher speed and remove a greater volume of mined material in a given time period thereby increasing the efficiency of the entire operation.

While several embodiments of the adjustable height yoke assembly of this invention has been shown in accordance with the invention, as well as methods of operation, it should apparent to those skilled in the art that what has been described is considered at the present to be a preferred embodiment of the adjustable height yoke assembly and the methods of application in accordance with this invention. In accordance with the patent statutes, changes may be made in the adjustable height yoke assembly and its operation in accordance with this invention without actually departing from the true spirit and scope of this invention. The following claims are intended to cover all such changes and modifications which fall in the true spirit and scope of this invention.

What is claimed is:

1. An adjustable height yoke assembly for connecting a bridge conveyor and a mobile bridge carrier in a continuous haulage system in underground excavations, said yoke assembly comprising:

a male yoke assembly including a coupling member carried on a horizontally extending male yoke plate, said male yoke plate supported on a dolly positioned over a conveyor and adapted for movement upon a mobile bridge carrier; and a female yoke assembly including a generally horizontally extending female yoke plate including a complimentary coupling mechanism for pivotally connecting said female yoke plate and said male yoke plate, said female yoke plate supported by an attachment frame including a series of vertically aligned apertures adapted to receive attachment bolts to adjustably secure said female yoke assembly to said bridge conveyor.

2. The adjustable height yoke assembly of claim 1 wherein said male yoke plate is bolted to a portion of said dolly.

3. The adjustable height yoke assembly of claim 1 wherein said attachment frame includes a pair of face plates interconnected to a pair of spaced apart angle support braces disposed generally perpendicular to said pair of face plates.

4. The adjustable height yoke assembly of claim 3 wherein said pair of face plates are integrally formed with said spaced apart angle support braces and said female yoke plate.

5. The adjustable height yoke assembly of claim 1 wherein said coupling member includes a connecting pin and said complimentary coupling mechanism includes an opening in said female yoke plate adapted to receive said connecting pin.

6. The adjustable height yoke assembly of claim 1 further including at least one spacer adapted to be secured between said male yoke plate and said dolly to raise the height of said male yoke plate relative to said mobile bridge carrier.

7. A bridge conveyor for interconnecting components of a continuous haulage conveyor system used in underground excavations comprising:

a conveyor carried on a support frame, said conveyor having a receiving end and a discharge end and means for moving the conveyor from said receiving end to said discharge end;

an adjustable height male yoke assembly connected to the receiving end of said support frame, said adjustable height male yoke assembly adapted to pivotally connect to a female yoke assembly on an adjacent continuous haulage conveyor system component;

an adjustable height female yoke assembly connected to the discharge end of said support frame, said adjustable height female yoke assembly adapted to pivotally connect to a male yoke assembly on an adjacent continuous haulage conveyor system component.

8. The bridge conveyor of claim 7 wherein said male yoke assembly includes a connecting pin carried on a horizontally extending male yoke plate, said male yoke plate supported by a pair of spaced apart vertically extending retainer plates, each of said retainer plates including a series of vertically aligned holes adapted to receive attachment pins for adjustably securing said male yoke assembly to said receiving end of said bridge conveyor.

9. The bridge conveyor of claim 7 wherein said female yoke assembly includes a generally horizontally extending female yoke plate including an opening therethrough for receiving a connecting pin of a corresponding male yoke plate, said female yoke plate supported by an attachment frame including a series of vertically aligned apertures adapted to receive attachment bolts to adjustably secure said female yoke assembly to the discharge end of said bridge conveyor.

10. The bridge conveyor of claim 7 wherein said attachment pins include bolts.

11. The bridge conveyor of claim 9 wherein said attachment frame includes a pair of face plates and a pair of spaced apart angle support braces disposed generally perpendicular to said face plate.

12. The bridge conveyor of claim 11 wherein said pair of face plates are integral with said spaced apart angle support braces.

13. The bridge conveyor of claim 8 wherein said connecting pin includes a cross pin extending therethrough and a cotter pin for connection of said male yoke assembly with a corresponding female yoke assembly.

14. The bridge conveyor of claim 8 wherein said retainer plates include two series of vertically aligned holes.

15. An adjustable height yoke assembly for connecting a bridge conveyor and a mobil bridge carrier of a continuous haulage system used in underground excavations, said adjustable height yoke assembly comprising a first yoke assembly including a coupling member carried on a generally horizontally extending first yoke plate, said first yoke plate supported by an attachment frame; a series of vertically aligned apertures disposed on said attachment frame and adapted to receive attachment bolts for securing said first yoke plate at pre-selected vertical positions on a dolly positioned over a conveyor and moveable upon a mobil bridge carrier; and a second yoke assembly including a generally horizontally extending second yoke plate including a complimentary coupling mechanism for pivotally connecting said second yoke plate and said first yoke plate, said second yoke plate carried on said bridge conveyor.

16. The adjustable height yoke assembly of claim 15 wherein said second yoke assembly support includes a connecting support member having a series of vertically aligned holes adapted to receive attachment bolts for securing said second yoke assembly to said bridge conveyor at pre-selected vertical positions.

* * * * *